US009704357B2

(12) United States Patent
Hasbach et al.

(10) Patent No.: US 9,704,357 B2
(45) Date of Patent: Jul. 11, 2017

(54) TRANSPORT GOODS MONITORING DEVICE

(71) Applicant: Airbus Operations GmbH, Hamburg (DE)

(72) Inventors: Volker Hasbach, Hamburg (DE); Oliver Nuessen, Hamburg (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 0 days.

(21) Appl. No.: 14/667,841

(22) Filed: Mar. 25, 2015

(65) Prior Publication Data

US 2016/0078730 A1 Mar. 17, 2016

(30) Foreign Application Priority Data

Mar. 26, 2014 (DE) ..... 10 2014 004 377

(51) Int. Cl.

| | |
|---|---|
| ***G08B 3/10*** | (2006.01) |
| ***B65D 79/02*** | (2006.01) |
| ***G08B 5/36*** | (2006.01) |
| ***G08B 13/12*** | (2006.01) |

(52) U.S. Cl.

CPC ..... *G08B 3/10* (2013.01); *B65D 79/02* (2013.01); *G08B 5/36* (2013.01); *G08B 13/126* (2013.01)

(58) Field of Classification Search

CPC ..... G08B 3/10; G08B 13/126; G08B 13/26
See application file for complete search history.

(56) References Cited

U.S. PATENT DOCUMENTS

| | | | | |
|---|---|---|---|---|
| 7,271,723 | B2 | 9/2007 | Ando | |
| 7,274,289 | B2 | 9/2007 | Kerr et al. | |
| 7,608,812 | B2 | 10/2009 | Beinhocker | |
| 2004/0046660 | A1* | 3/2004 | Ando | G08B 13/186 340/545.6 |
| 2009/0115607 | A1* | 5/2009 | Beinhocker | G08B 13/126 340/541 |

FOREIGN PATENT DOCUMENTS

| | | | |
|---|---|---|---|
| DE | 102009030703 | A1 | 12/2010 |
| WO | 2010149670 | A1 | 12/2010 |

OTHER PUBLICATIONS

German Patent Office, German Search Report for German Patent No. 10 2014 004 377.0, mailed Oct. 31, 2014.

* cited by examiner

*Primary Examiner* — Curtis Odom
(74) *Attorney, Agent, or Firm* — Lorenz & Kopf, LLP.

(57) ABSTRACT

There is disclosed inter alia a transport goods monitoring device having a cover which is configured to cover transport goods received by a transport goods receptacle, the cover comprising a conductor arrangement, the conductor arrangement being in a first state when the cover is intact, the conductor arrangement being transformable from the first state into a second state by damage of the cover and the conductor arrangement being connectable to a detector which is configured to detect the existence of the second state. Furthermore, there is disclosed an arrangement comprising a transport goods receptacle which is configured to receive transport goods, and such a transport goods monitoring device, the cover of the transport goods monitoring device covering the transport goods receptacle and optionally transport goods arranged thereon. Also disclosed is the use of such a transport goods monitoring device for safeguarding transport goods received by a transport goods receptacle.

10 Claims, 4 Drawing Sheets

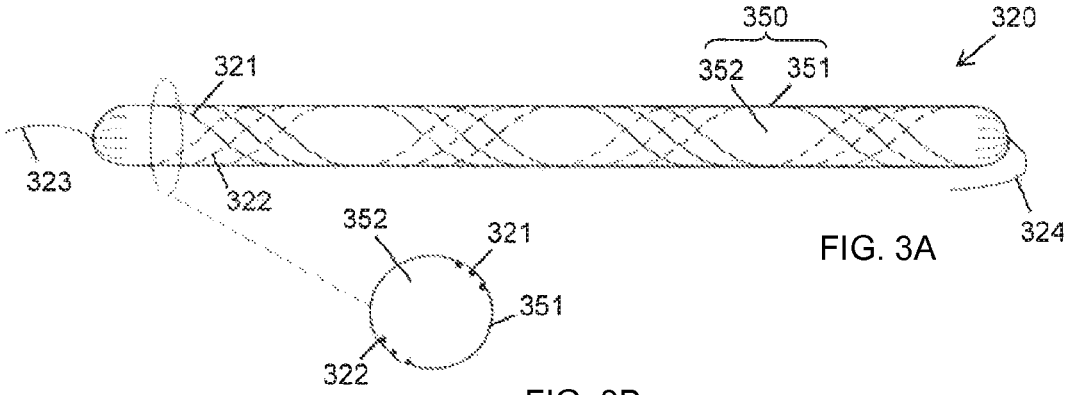
FIG. 3A
FIG. 3B
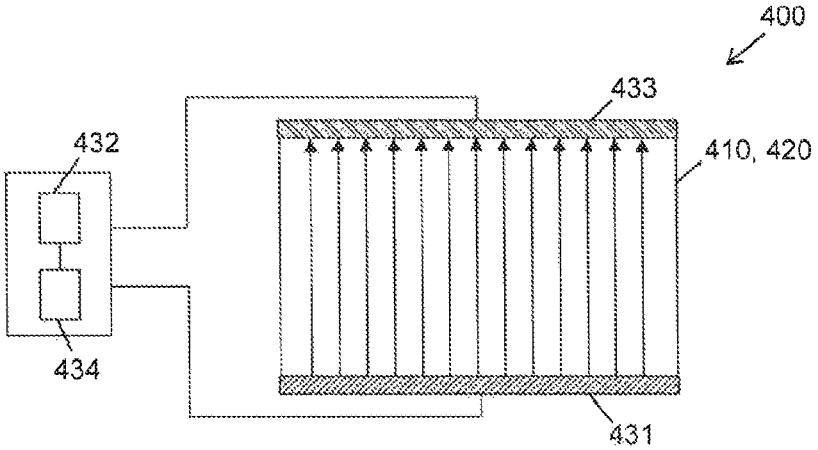
FIG. 4A
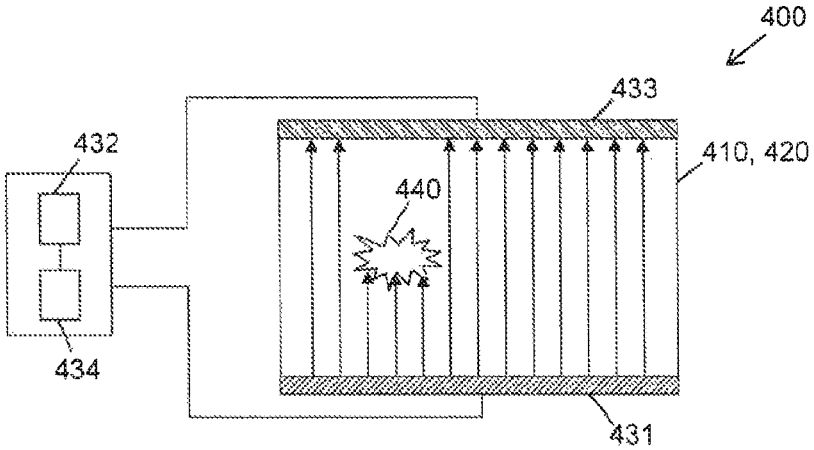
FIG. 4B

TRANSPORT GOODS MONITORING DEVICE

CROSS-REFERENCE TO RELATED APPLICATION

This application claims priority to German Patent Application No. 10 2014 004 377.0 filed Mar. 26, 2014, which is incorporated herein by reference in its entirety.

TECHNICAL FIELD

The embodiments described herein relate in general to transport goods monitoring. In particular, the embodiments described herein relate to a transport goods monitoring device having a cover that is configured to cover transport goods received by a transport goods receptacle, to an associated arrangement comprising a transport goods receptacle and such a transport goods monitoring device, and to the use of the transport goods monitoring device.

BACKGROUND

Customers of transport companies would like their transport goods to reach their destination undamaged. For this purpose, it is known, for example, to monitor environmental parameters during transportation. For example, a temperature can be detected if perishable transport goods are being transported. The detection of environmental parameters is known, for example, from DE 10 2009 030 703 A1 and WO 2010/149670 A1.

As well as damage to the transport goods due to environmental influences, direct action on the transport goods may, however, also be critical. The theft thereof should thus be prevented as much as possible. The unauthorised addition of further transport goods, e.g. smuggled goods or dangerous articles such as explosives, must likewise be prevented. Against this background, the provision of possibilities for more comprehensive monitoring of the integrity of transport goods is desirable.

According to a first aspect, a transport goods monitoring device having a cover that is configured to cover transport goods received by a transport goods receptacle is proposed. The cover comprises a conductor arrangement. The conductor arrangement is in a first state when the cover is intact. The conductor arrangement is transformable from the first state into a second state due to damage of the cover. The conductor arrangement is connectable to a detector that is configured to detect the existence of the second state.

A second aspect relates to an arrangement comprising a transport goods receptacle that is configured to receive transport goods, and such a transport goods monitoring device, the cover of the transport goods monitoring device covering the transport goods receptacle and optionally the transport goods arranged thereon.

A third aspect relates to the use of such a transport goods monitoring device for safeguarding transport goods received by a transport goods receptacle.

The present disclosure is described below with the primary focus on the first aspect for reasons of clarity, with the following discussions applying analogously to the second and third aspect.

If the cover of the transport goods monitoring device is intact, the conductor arrangement is in the first state. If, however, the cover is damaged, the conductor arrangement changes into the second state. Since the existence of the second state of the conductor arrangement is detectable by the detector and the second state indicates the damage of the cover, the cover can be monitored for the occurrence of damage. If the cover covers the transport goods, the damage of the cover can indicate an impairment of the integrity of the transport goods. A monitoring of the integrity of the transport goods can therefore be performed by means of the transport goods monitoring device. It is thus possible to obtain clues to the occurrence of damage of the transport goods, to the theft of transport goods or to the unauthorised addition of further transport good, to name but a few examples.

If the transport goods receptacle, for example a container that contains the transport goods or a pallet on which the transport goods are arranged, is encompassed by the cover, the integrity of the transport goods receptacle can also be monitored. The cover may herein some cases cover the transport goods only indirectly, for example because it directly covers a transport goods receptacle inside which the transport goods are situated, for example a container, but is not in direct contact with the transport goods. A further example in which the transport goods are covered only indirectly is, for example, when the transport goods are arranged on a pallet, are secured on the pallet by a net, and the cover lies on the net instead of directly on the transport goods.

Data collected by the transport goods monitoring device on the integrity status of the transport goods or the transport goods receptacle, can, for example, when the existence of the second state and thus damage of the cover has been detected, be transmitted to a monitoring entity, optionally in real time, from the means of transport respectively employed, e.g. an aircraft. Continuous monitoring of the transport goods becomes possible.

The cover of the transport goods monitoring device can be configured to cover the transport goods completely or only partially. An only partial covering may be present, for example, because the cover is of a net-like structure, and the cover of the transport goods thus has openings. A further example is when the cover is, for example, of strip-like or tube-like form and owing to its geometry is not designed to cover the respective transport goods completely. As already mentioned, the cover of the transport goods can be both direct and indirect. An indirect cover exists when the cover covers only the transport goods receptacle in a direct manner and the transport goods are arranged or are being arranged in the transport goods receptacle. The cover can also be configured to at least partially cover, in each case, both the transport goods and the transport goods receptacle in a direct manner. Such a case exists when the cover is designed such that it partially surrounds the transport goods and at the same time at least partially surrounds a pallet on which the transport goods are arranged.

The cover can also be partially or completely a component part of the transport goods receptacle. For example, the cover can thus be formed by at least one outer surface of the transport goods receptacle, e.g. the cover can be formed by walls of a transport goods container, e.g. a container ULD. Transport goods receptacles can be produced directly with a cover, or existing transport goods receptacles can be converted. The cover can alternatively also be a unit separate from the transport goods receptacle.

The cover can be variously designed. It can be rigid or flexible and have different geometries. A wide range of basic materials are possible for the cover, e.g. metals, plastics, glass, etc.

The transport goods can in the context be any transportable merchandise. For example, the transport goods may be piece goods, or liquids, gases or any other merchandise. Also animals are regarded as possible transport goods here. According to one embodiment, the transport goods are air transport goods.

The transport goods receptacle can, for example, be configured as an open or closed container that surrounds the transport goods on a plurality of sides. Provision may, however, also be made for the transport goods receptacle to be formed as a transport goods carrier on which the transport goods can be set down, to name just one further example.

According to one embodiment, the transport goods receptacle is a transport goods receptacle for air transport. According to one embodiment, the transport goods receptacle is a so-called Unit Load Device (ULD). ULDs are used for the air transport of transport goods. They are available as variants adapted to specific aircraft types. There exist two basic types of ULDs. They can be on the one hand in the form of containers and on the other hand in pallet form. The pallets usually have eyes, by means of which cargo nets can be secured. The pallets are often made largely of aluminium. In many cases, aluminium is also used as the material for container ULDs. However, other materials, such as plastics, acrylic glass or textile materials are also used. Frequently, container ULDs are made of a combination of these or other materials. For example, they have a metal frame and plastic walls, or the individual walls of a container ULD are made of different materials (composite container). For the transport of perishable transport goods, both actively and passively cooled container ULDs are available. Furthermore, specially adapted ULDs exist e.g. for the transport of animals or vehicles.

The conductor arrangement of the cover can be designed for the conducting of different signal types, for example by having one or more conductors suitable for the respective signal type. A further possibility is that the basic material of the cover itself is able to conduct the signal type in question sufficiently well, so that the conductor arrangement is formed by the basic material itself and separate conductors do not necessarily have to be provided.

The conductor arrangement is in a first state when the cover is intact and is transformable from the first state into a second state when the cover is damaged. Thus, there exists at least one kind of damage of the cover that affects the state of the conductor arrangement. It is not necessary for any damage of the cover to affect the state of the conductor arrangement. For example, damage at particular places of the cover may have no effect on the state of the conductor arrangement. It is also conceivable for certain kinds of damage to leave the state of the conductor arrangement uninfluenced. For example, only very superficial damage of the cover occurs when a conductor arrangement is situated in its interior.

The fact that the conductor arrangement is transformable from the first into the second state by the damage may, for example, mean that the transformation into the second state takes place inevitably when corresponding damage occurs. In this case, there thus exists an automatism between the occurrence of the damage and the transition to the second state. The second state is different from the first state. The second state may differ from the first state by at least one altered property of the conductor arrangement.

The detector can contain a signal source, which can be applied to the conductor arrangement for the purpose of detecting the existence of the second state. The signal can be adapted to the type of conductor arrangement. For example, in the case of an electrical conductor arrangement, an electrical signal can be used, and in the case of an optical conductor arrangement, an optical signal can be used. The application of the signal can take place, for example, permanently or only at particular monitoring instants.

The detector can comprise a measuring device, by which a signal of the type used, e.g. electrical or optical, can be picked up and/or evaluated with regard to at least one property. An alteration of the conductor arrangement in the second state compared with the first state, which affects the signal or at least one of its properties, can then be picked up by means of the measuring device. The existence of the second state can thus be detected. The circuit arrangement of signal source and measuring device relative to one another and with respect to the conductor arrangement can be adapted to the signal type.

The detector can comprise, for example, an energy source that supplies the signal source and the measuring device and optionally further components with energy.

According to one embodiment, the transport goods monitoring device comprises the detector and the detector, is connected to the conductor arrangement.

According to another embodiment, the detector is configured to cause an output of a signal upon detection of the second state.

In this way, information about the existence of the second state can be communicated, and optionally an appropriate reaction performed. For example, an inspection of the transport goods monitored by means of the transport goods monitoring device can be performed by a person.

Various signal types are possible for the signal. For example, the signal can be an acoustic signal. For the output of an acoustic signal the detector can comprise a loudspeaker or the detector can be assigned a loudspeaker. The signal can also be an optical signal. For the output of the optical signal, there can be provided, for example, at least one lamp, e.g. a light emitting diode, that lights up or goes out on the existence of the second state. An optical signal can, however, for example, also be output on a screen provided therefore; for example, a liquid crystal screen or a cathode ray screen. For example, the optical signal can appear on the screen as text and/or graphics.

The causing of the output of the signal by the detector can be effected, for example, by the detector being configured to generate the signal and supply it to the respective output means for the output. The signal can, however, also be generated by the output means itself, which can be initiated, for example, by a suitable triggering signal of the detector that is supplied to the output means. The signal or the triggering signal can be supplied to external output means, e.g. in a wired or wireless manner, for example by means of radio signals. For this purpose, there can be provided, for example, a corresponding transmitter on the detector.

According to one embodiment, the second state is distinguished by an altered conducting function of the conductor arrangement in comparison with the first state.

On appropriate configuration of the detector, the existence of the second state can thus be recognised in a direct or indirect manner by the changed conducting function of the conductor arrangement. This can allow a particularly simple detection of the existence of the second state.

For example, either the second state compared with the first state can be distinguished by a reduced conducting function of the conductor arrangement or the first state compared with the second state can be distinguished by a reduced conducting function of the conductor arrangement.

The altered conducting function can, for example, be an altered electrical or optical conducting function. The altered conducting function of the conductor arrangement, can appear, for example, as altered conductivity.

A signal can be applied to the conductor arrangement that is suitable for being conducted by the conductor arrangement in at least one state of the conductor arrangement, i.e. at least in the first state of the conductor arrangement or at least in the second state of the conductor arrangement. In this case, the altered conducting function of the conductor arrangement can be manifested, for example, in a weakening or strengthening of the signal compared with the first state of the conductor arrangement. The existence of the second state can be detected by the detector on the basis of this weakening or strengthening. The weakening can extend as far as the reduction of the signal to a strength no longer detectable.

According to one embodiment, the transport goods monitoring device is assigned a signal source for applying a signal to the conductor arrangement that is suitable for being conducted by the conductor arrangement in at least one state of the conductor arrangement.

The signal source can, depending on the conductor arrangement, for example be an electrical or an optical signal source. The assignment of the signal source to the transport goods monitoring device can, for example, consist in that the signal source is part of the transport goods monitoring device, e.g. of the detector. On the other hand, the signal source can also be external with respect to the transport goods monitoring device, for example because it is stationarily arranged in a means of transport, e.g. an aircraft, a ship or a lorry, while the transport goods monitoring device is mobile and can be moved with the transport goods. The signal source can be assigned an energy source that provides energy required for the signal generation.

According to one embodiment, the conductor arrangement is an electrical conductor arrangement. If the conductor arrangement is an electrical conductor arrangement and if an electrical signal is applied to the conductor arrangement, different electrical properties of the conductor arrangement in its first and its second state can be detected by the detector. The detecting and further processing of an electrical signal influenced by the conductor arrangement, optionally, is particularly simple.

Transport goods receptacles in many cases have at least one metallic element that can serve as electrical conductor of the electrical conductor arrangement. For example, at least one metallic wall of a transport container, e.g. a container ULD, can be used for this purpose.

According to another embodiment, the conductor arrangement is an optical conductor arrangement. If the conductor arrangement is an optical conductor arrangement and if an optical signal is applied to the conductor arrangement, different optical properties of the conductor arrangement in its first and its second state can be detected by the detector from the signal.

For optically conducting elements (light conductors) of an optical conductor arrangement, transparent materials, e.g. acrylic glass, can be used. It may therefore be possible to integrate such optically conducting elements of the conductor arrangement in likewise transparent elements of the cover, so that these elements are only slightly visually conspicuous, or not at all. This may be advantageous when the cover is a component part of a transport goods receptacle that has transparent elements. For example, the transport goods receptacle may be a container with at least one acrylic glass wall element, e.g. a container ULD with an acrylic glass wall, and the optical conductor arrangement may be integrated into the acrylic glass wall element.

According to one embodiment, the conductor arrangement comprises at least one conductor that is closed in the first state of the conductor arrangement and that is interrupted in the second state of the conductor arrangement.

If a signal is applied to the conductor arrangement and thus to the conductor that is suitable for being conducted by the conductor arrangement in at least one state of the conductor arrangement, the signal conducting function of the conductor may be impaired in the second state of the conductor arrangement by the interruption of the conductor owing to the damage of the cover, e.g. by a cutting tool. A detector can then detect the absence of the signal, which reaches it in the first state through the conductor, as a sign of the existence of the second state and thus detect the existence of the second state.

In the context of this embodiment, the conductor may be the essential element of the conductor arrangement or, optionally, apart from an insulation surrounding it, even the only component of the conductor arrangement. Both electrical and optical conductors may have a small space requirement and additionally also be flexible, for example in the case of an electrical conductor in the form of a wire or of an optical conductor in the form of a glass fibre. Particularly various possibilities for integration of the conductor arrangement into a cover may thus present themselves. For example, the conductor arrangement may be integrated both into a strip or tube-shaped cover as well as into a net-like cover, a covering tarpaulin, or a covering sheet.

The conductor arrangement or the cover can be designed such that, on normal handling during loading operations and during transportation, there is no damage of the cover and hence of the conductor arrangement.

According to one embodiment, the conductor arrangement has a first conductor and a second conductor, the first conductor and the second conductor being insulated from one another by an insulator arrangement in the first state of the conductor arrangement and an electrically conductive connection existing between the first conductor and the second conductor in the second state.

Since in the first state of the conductor arrangement the first conductor is electrically insulated from the second conductor by the insulator arrangement, no current flow is possible via the first conductor to the second conductor and vice versa, at least in the limits of the insulation effect of customary insulators. The first state of the conductor arrangement exists when the cover is intact and should thus be the normal case that is present most of the time. In the case of an electrical signal, this may mean that in this normal case characterised by an open conductor arrangement, energy for maintaining the signal flow can thus be saved.

It is understood that, in the context of this embodiment, the first conductor and the second conductor are electrical conductors, and an electrical signal is provided for application to the conductor arrangement.

According to one embodiment, the insulator arrangement is configured to be penetrated, in the second state of the conductor arrangement, by the first conductor, so that the latter contacts the second conductor.

A conductor arrangement can thus be realised with a simple structure, which arrangement is open in the first state, i.e. in the normal state, so that energy for maintaining the signal flow can be saved.

The insulator arrangement can comprise, for example, an insulation layer. Also, for example, the first conductor and the second conductor can be formed as conducting layers surrounding the insulation layer. This layered structure can be implemented particularly simply in terms of production.

The insulation layer can be formed so thin that, even if one of the conductors is damaged over a small area, a piece of the respective conductor pushed in the direction of the insulator layer is of sufficient length to penetrate the insulator arrangement and electrically contact the respectively other conductor.

Further possible variant is that the insulator arrangement comprises an insulation layer, and the first and/or the second conductor are formed as a fine-meshed net.

According to one embodiment, the insulator arrangement has at least one chamber that is filled with an insulation medium in the first state of the conductor arrangement, and that is configured to collapse and to allow the insulation medium to escape in the event of damage of the chamber.

In this way, a further conductor arrangement can be realised, which is open in its first state, so that energy for maintaining the signal flow can be saved. It may be sufficient here if the cover, and thus the conductor arrangement encompassed by it and especially the chamber thereof, is damaged at one place, in order to collapse and allow the insulation medium to escape. This place may optionally have a small area. The place at which the chamber is damaged may optionally not even lie in the immediate vicinity of the first and of the second conductor. Nevertheless, an electrical contact between the first conductor and the second conductor can take place owing to the escape of the insulation medium and the collapse of the chamber, so that a conductive connection between the conductors results.

In order for the chamber to collapse when the insulation medium escapes, it can be formed, for example, from a flexible material, e.g. a plastic film. The chamber can be designed such that, on normal handling of the cover during loading operations and during transportation, there is no damage of the chamber. The conductors can be formed, for example, as strip conductors and integrated into the plastic film. A conductor arrangement can have a plurality of separate chambers of the kind described above.

The insulation medium can, for example, be in the form of granules.

According to one embodiment, the insulation medium is a fluid insulation medium, i.e. a gas or a liquid.

A fluid insulation medium may, in some cases, quickly substantially completely escape from the chamber, even if the place of damage is only small. Moreover, gas has only a low weight.

As a gaseous fluid insulation medium, for example, air can be used. It offers good electrical insulation properties, has unlimited availability, and does not pollute the environment if it escapes.

According to one embodiment, the fluid insulation medium in the first state of the conductor arrangement is under pressure. The chamber can then be swollen by the fluid insulation medium. Optionally, the fluid insulation medium can then escape particularly quickly.

According to one embodiment, the cover is of flexible design.

The flexible design of the cover can enable the cover to be put on transport goods to be covered or on a transport goods receptacle in an uncomplicated manner. This may also apply to transport goods receptacles that have not been designed specifically for use as a transport goods monitoring device. Owing to its flexibility, the cover can be foldable and thus stowed in a space-saving manner. It does not have to be integrated into the transport goods receptacle, and is therefore suitable for the non-invasive upgrading of existing transport goods receptacles.

The flexible cover can be equipped with at least one connecting element that is configured to be connected to a corresponding counterpart in a means of transport, e.g. an aircraft, a ship, or a lorry. A detector can be provided that is configured to ascertain whether a contact between the connecting element and the counterpart exists or not, or no longer exists. With this approach, additional monitoring security can be obtained if the flexible cover does not cover the transport goods or the transport goods receptacle on all sides. For example, in the case of a pallet as the transport goods receptacle, the underside of the pallet may not be covered by the cover, but the cover may be secured on a floor area of the means of transport by connecting element and counterpart. If connecting element and counterpart are separated from one another, in order to be able to lift the cover, this can be detected. For the detection of the separation of connecting element and counterpart, an appropriate, e.g. electrical or optical, signal can be applied to them. Appropriate conductors can be provided in connecting element and counterpart. Optionally, the detector for the monitoring of the contact of connecting element and counterpart may coincide with the detector that is configured to detect the existence of the second state of the conductor arrangement.

According to one embodiment, the flexibly designed cover is in the form of a covering. Such a covering may be suitable for adapting to widely varying geometries of the transport goods or the transport goods receptacle.

According to one embodiment, the flexibly designed cover is in the form of a bag. The bag can be put on to cover the transport goods or the transport goods receptacle in an uncomplicated manner, for example by slipping it over the transport goods or the transport goods receptacle. The bag may have a closure, e.g. a zip fastener, one or more buttons, a draw-string etc., so that in a closed state it forms a closed envelope. The closure may be sealable so that unauthorized opening of the closure becomes less likely. Alternatively, however, the bag may also be open and have no closure.

According to one embodiment, the bag is configured to be received in the interior of a transport goods receptacle in the form of a container and/or the transport goods receptacle in the form of a container is configured to receive the bag in its interior. For this purpose, fastening means may be provided on the bag and/or the container, in order to secure the bag to the container. The bag may be configured to be received between an outer surface of the container and space, situated in the container, for receiving the transport goods and/or the container may be configured to receive the bag between an outer surface of the container and space, situated in the container, for receiving the transport goods.

If the bag is arranged in the interior of the transport goods receptacle, good protection of the bag can be provided. On normal handling of the transport goods receptacle during loading operations and during transportation, damage of the bag and thus of the conductor arrangement can be avoided.

According to one embodiment, the cover comprises rigid walls and is of foldable design. Thus, the cover can on the one hand be stable and on the other hand, nevertheless, be folded and thus stowed in a space-saving manner. It does not have to be integrated into the transport goods receptacle, and is therefore suitable for the non-invasive upgrading of existing transport goods receptacles.

The cover can be adapted to the geometry of the transport goods receptacle. For example, the dimensions of the cover can be chosen such that, in the erected state, it is adapted to the contours of a transport goods receptacle in the form of a container, e.g. a container ULD, and is only negligibly larger than the container. The cover can be closed, so that it can completely cover, for example, a transport goods receptacle together with transport goods. It can, however, also be open, so that, for example, the underside of the transport goods receptacle is not encompassed by the cover.

In order to stabilise the cover in its erected state, at least one component can be provided that connects at least two rigid walls of the cover to one another. For example, such a component can be formed as a connecting strap.

According to one embodiment, the transport goods monitoring device comprises at least one sensor that is configured to pick up an environmental parameter.

Through the sensor, in addition to the monitoring of the transport goods or of the transport goods receptacle by the cover and the detector using the transport goods monitoring device, environmental parameters can also be monitored as well.

The sensor can, for instance, be a temperature sensor, a pressure sensor, a humidity sensor, or a chemical sensor, to name but a few examples. The sensor can be arranged, for example, in or in the vicinity of the cover.

BRIEF DESCRIPTION OF THE DRAWINGS

The various embodiments and example configurations of the present disclosure described above in this specification are also to be disclosed in all combinations with one another.

Further example configurations are to be found in the following detailed description of some example embodiments, for example in conjunction with the figures.

The figures accompanying the application serve merely to illustrate embodiments. They are not to scale and are merely intended to reflect the general concept of the disclosure by way of example. For example, features that are included in the figures should in no way be considered to be a necessary component.

Figure 1A:
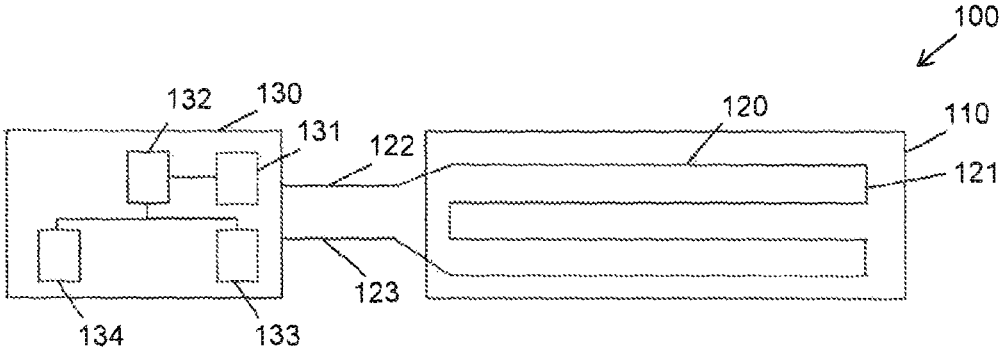
Figure 1B:
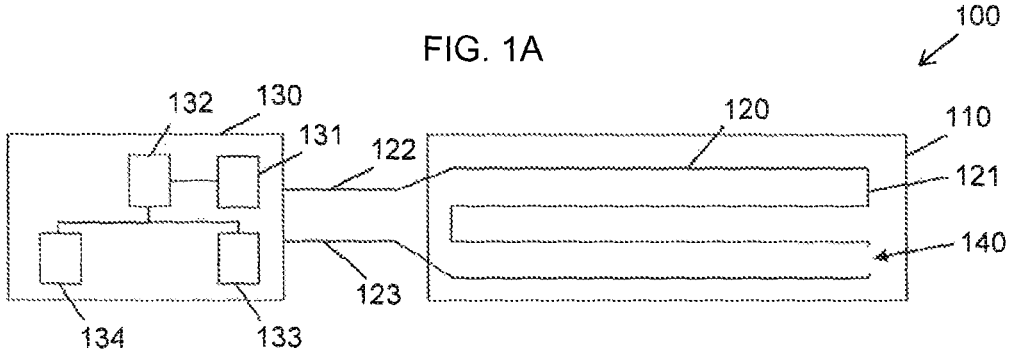
Figure 2A:
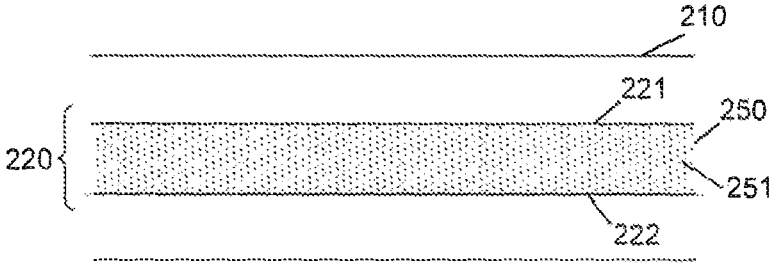
Figure 2B:
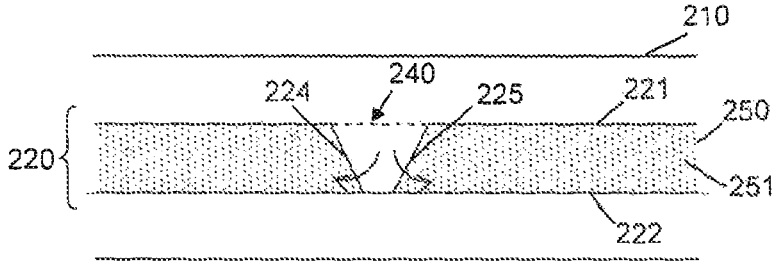
Figure 5A:
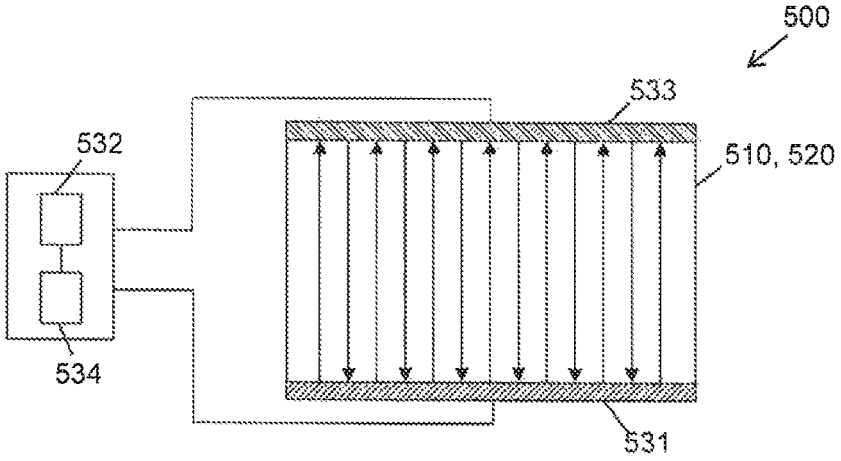
Figure 5B:
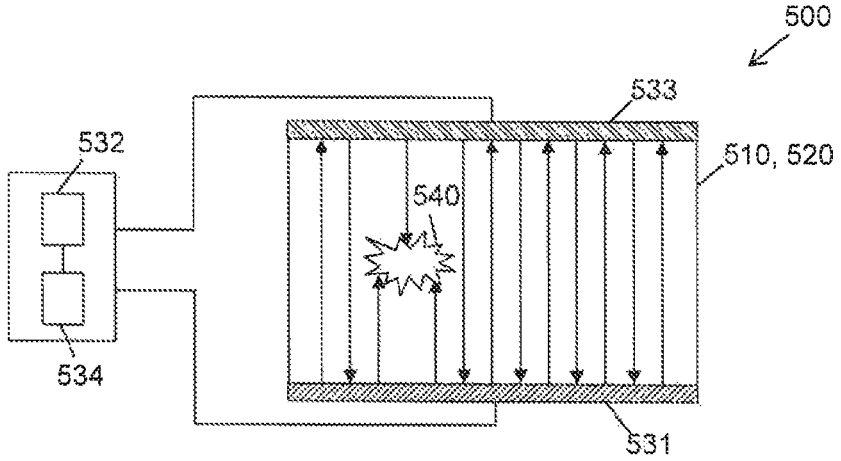
Figure 6A:
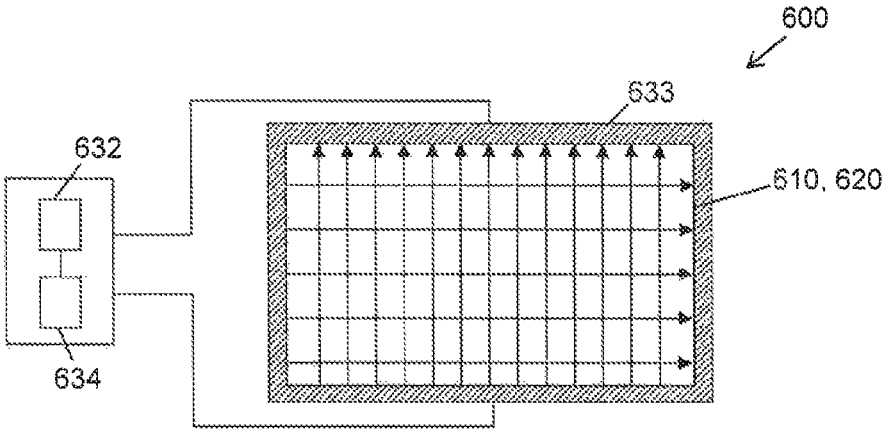
Figure 6B:
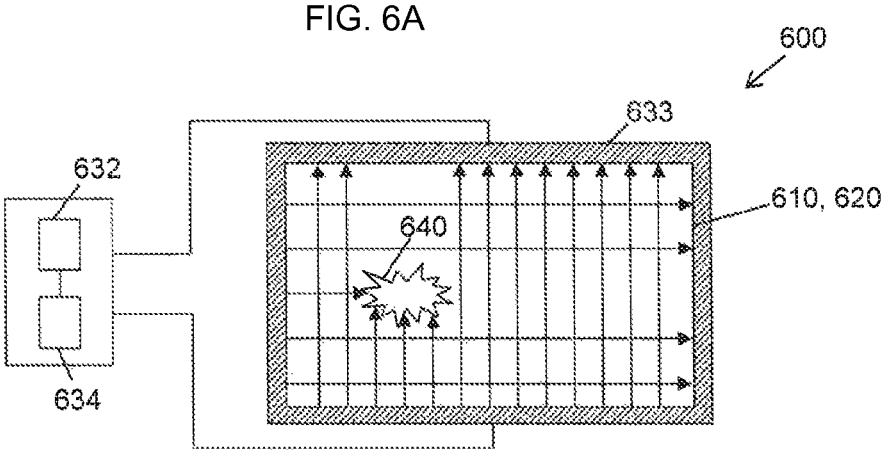

FIG. 1A is a schematic representation of a first embodiment of a transport goods monitoring device;

FIG. 1B is a schematic representation of the transport goods monitoring device from FIG. 1A after damage of the cover of the transport goods monitoring device has occurred;

FIG. 2A is a schematic representation of a cross-section of an embodiment of a cover that can be used in an embodiment of a transport goods monitoring device;

FIG. 2B is a schematic representation of the cross-section of the cover from FIG. 2A after damage of the cover has occurred;

FIG. 3A is a schematic representation of a side view of an embodiment of a conductor arrangement that can be used in an embodiment of a transport goods monitoring device;

FIG. 3B is a schematic representation of a cross-section of the conductor arrangement from FIG. 3A;

FIG. 4A is a schematic representation of a second embodiment of a transport goods monitoring device;

FIG. 4B is a schematic representation of the transport goods monitoring device from FIG. 4A after damage of the cover of the transport goods monitoring device has occurred;

FIG. 5A is a schematic representation of a third embodiment of a transport goods monitoring device;

FIG. 5B is a schematic representation of the transport goods monitoring device from FIG. 5A after damage of the cover of the transport goods monitoring device has occurred;

FIG. 6A is a schematic representation of a fourth embodiment of a transport goods monitoring device; and FIG. 6B is a schematic representation of the transport goods monitoring device from FIG. 6A after damage of the cover of the transport goods monitoring device has occurred.

DETAILED DESCRIPTION

FIG. 1A is a schematic representation of a first embodiment of a transport goods monitoring device 100. The device 100 comprises a cover 110 (represented only symbolically in FIG. 1A). In the cover 110 there is integrated a conductor arrangement 120. The latter comprises a conductor 121 that is arranged as a conductor loop in the cover. Furthermore, there is provided a detector 130 that is connected to the conductor arrangement 120. The detector 130 contains a signal source 131, an energy source 132, a measuring device 133, and a transmitter 134, e.g. for wired information transmission or for generating radio signals.

The energy source 132, e.g. a battery, supplies the signal source 131, the measuring device 133, and the transmitter 134 with energy. The measuring device 133 as well as the signal source 131 are connected to the conductor arrangement 120, i.e. to the conductor 121.

In FIG. 1A the cover 110 is intact, so that the conductor arrangement 120 is in a first state. This first state is distinguished by a closed conductor 121. A signal of the signal source 131 that is applied to the conductor arrangement 121 can thus be conducted by the conductor 121. After passing through the conductor 121, it can be picked up by the measuring device 133 without the latter indicating a significant weakening of the signal.

FIG. 1B shows a schematic representation of the transport goods monitoring device 100 from FIG. 1A after damage of the cover of the transport goods monitoring device 100 has occurred. It may have been caused, for example, by a sharp object acting on the cover 110. It is at a place 140 of the cover 110. The damage has also affected the conductor arrangement 120, as shown in FIG. 1B. It is manifested in an interruption of the conductor 121 at the place 140. Owing to the damage of the cover 110, the conductor arrangement 120 has thus changed from its first state into a second state. The second state of the conductor arrangement 120 is distinguished by a reduced conducting function of the conductor arrangement 120 in comparison with its first state. In fact, the conducting function here no longer exists at all, on account of the interruption.

The signal that is applied to the conductor arrangement 120 by the signal source 131 can no longer completely pass through the conductor arrangement 120. The measuring device 133 registers this in the form of a weakening of the signal to zero. It thus detects the existence of the second state. As a reaction to this, the measuring device 133 outputs a triggering signal to the transmitter 134. Thereupon, the latter emits an alarm signal that can be received by a receiver, e.g. in a monitoring room, and can cause there, for example, a visual warning on a screen or an acoustic warning from a loudspeaker.

If the cover 110 covers transport goods received by a transport goods receptacle, the damage of the cover 110 may indicate an impairment of the integrity of the transport goods. A monitoring of the integrity status of the transport goods can therefore be performed by means of the transport goods monitoring device 100. It is thus possible, for example, to obtain clues to the occurrence of damage of the transport goods, to the theft of transport goods or to the unauthorised addition of further transport goods. If the transport goods receptacle, for example a container which contains the transport goods or a pallet on that the transport goods are arranged is encompassed by the cover 110, the integrity of the transport goods receptacle can optionally also be monitored.

The conductor arrangement 120 can, for example, be an electrical conductor arrangement or an optical conductor arrangement. In the case of an electrical conductor arrangement 120, the conductor 121 can be an electrical conductor, e.g. an insulated wire. In the case of an optical conductor arrangement 120, the conductor 121 can be an optical conductor (light conductor), e.g. a glass fibre. The signal source 131 is adapted to the type of conductor arrangement 121, i.e. in the case of an electrical conductor arrangement 120 there is provided a signal source 131 that generates an electrical signal. In the case of an optical conductor arrangement 120 there is provided a signal source 131 that generates a light signal. In the same way, the measuring device 133 is also adapted so that it can also pick up the respective signal provided it can pass through the conductor. The arrangement of the signal source 131 and of the measuring device 133 are also adapted to the conductor arrangement 120 and to the signal type. Thus, for example in the case of an optical conductor arrangement 120, the measuring device 133 is connected to a first end 122 of the conductor 121 and the light signal source 131 is connected to a second end 123 of the conductor. In the case of an electrical conductor arrangement 120, by contrast, the signal source 131, e.g. a voltage source, can be connected to both ends 122, 123 of the conductor arrangement and also the measuring device 133 can be connected into the circuit thus formed, in order to be able to detect a current flow or the absence thereof.

The conductor arrangement 120 used in the embodiment, that consists of the conductor 121 here, opens up a variety of possibilities for integration of the conductor arrangement 120 into a cover. The conductor 121 requires little space and, moreover, can also be flexible as well, for example in the case of an insulated wire or a glass fibre. Therefore, the conductor arrangement 120 can be integrated, for example, both into a strip-shape, a tube-shape or a net-like cover 110 as well as into a covering tarpaulin or a covering sheet.

FIG. 2A shows a schematic representation of a cross-section of an embodiment of a cover 210 that can be used in an embodiment of a transport goods monitoring device.

The cover 210 differs from the cover 110 from FIGS. 1A and 1B at least in that it comprises a different conductor arrangement 220. The electrical conductor arrangement 220 has a first electrical conductor 221 and a second electrical conductor 222. In the embodiment discussed here, they are of layered form. The conductor arrangement 220 furthermore comprises an electrical insulator arrangement 250 that is arranged between the conductors 221 and 222. This insulator arrangement comprises an insulator material 251 that is an insulating plastic in the embodiment. The insulator arrangement 250 insulates the first conductor 221 and the second conductor 222 electrically from one another.

In FIG. 2A the cover 210 is intact, so that the conductor arrangement 220 is in a first state. When a voltage is applied to the conductor arrangement 220, given sufficient insulating power of the insulator material 251, no electric current can flow from the first conductor 221 to the second conductor 222 or vice versa.

FIG. 2B shows a schematic representation of the cross-section of the cover 210 from FIG. 2A after damage of the cover 210 has occurred. The damage is at a place 240 and may have been caused, for example, by an object pushing in the cover 210. As shown in FIG. 1B, the damage of the cover 210 has also affected the conductor arrangement 220. It is manifested in a penetration of the insulator arrangement 250 at the place 240 by the first conductor 221. The portions 224 and 225 of the latter have displaced the insulation material 251 to the side, as indicated by the two arrows in FIG. 2B. The boundary line of the insulator arrangement 250 is marked by a dashed line at the place 240.

The insulator material 251 is formed so thin that, even if the cover 210 is damaged over a small area, the portions 224 and 225 of the first conductor 221 are of sufficient length to penetrate the insulator arrangement 250 and electrically contact the second conductor 222. An electrically conductive connection then exists. Owing to the damage of the cover 210, the conductor arrangement 220 has thus changed from its first state into a second state. The second state of the conductor arrangement 220 is distinguished by an increased conducting function of the conductor arrangement 220 in comparison with its first state. While in the first state of the conductor arrangement 220 no electric current can flow, this is possible in the second state. The current flow can be registered by a detector, such as, for example, the detector 130 from FIGS. 1A and 1B or its measuring device 133, and thus the existence of the second state can be detected. In this way, the damage of the cover 210 can be ascertained.

Since, in the first state of the conductor arrangement 220, the first conductor 221 is electrically insulated by the insulator arrangement 250 from the second conductor 222, no current flow is possible via the first conductor 221 to the second conductor 222, or vice versa. The first state of the conductor arrangement 220 exists when the cover 210 is intact and should thus be the normal case that is present most of the time. In this normal case characterised by an open conductor arrangement 220, energy for maintaining a current flow can thus be saved.

The layered structure of the conductor arrangement 220 can be implemented particularly simply in terms of production.

FIG. 3A shows a schematic representation of a side view of an embodiment of a conductor arrangement 320 that can be used in an embodiment of a transport goods monitoring device. FIG. 3B shows a schematic representation of a cross-section of the conductor arrangement 320 from FIG. 3A. The conductor arrangement 320 has a group of first conductors 321 and a group of second conductors 322, which are each formed as strip conductors. The first and the second conductors are integrated into a flexible plastic film 351. The plastic film 351 is shaped into a tube, which forms a chamber 352. The latter is filled, in the first state of the conductor arrangement 320 illustrated in FIGS. 3A and 3B, with an insulation medium that is a fluid insulation medium, specifically air. The plastic film 351, the chamber 352 and the air present therein form an insulator arrangement 350. In the first state of the conductor arrangement 320 shown, the air in the chamber 352 is under an overpressure, so that the chamber 352 is swollen by the insulation medium. As a result, the first conductor 321 and the second conductor 322 do not touch each other. In this first state, the insulation medium prevents a current flow between the first conductors 321 and the second conductors 322 when an electrical signal is applied to the conductor arrangement 320. In this normal case characterised by an open conductor arrangement 320, energy for maintaining a current flow can therefore be saved.

If the plastic film 351, and thus the chamber 352, because of damage of a cover encompassing it, is likewise damaged, e.g. perforated, the insulation medium, i.e. the air, can escape from the chamber 352. Therefore, the chamber 352 collapses. The first conductors 321 and the second conductors 322 thereby come into contact. An electrically conductive connection results. This also happens if the damage has been caused by an electrically insulating object. The conductor arrangement 320, because of the damage of the cover encompassing it and the damage of the chamber 352 resulting therefrom, has changed into a second state. It is distinguished by an increased conducting function in comparison with its first state. This can be ascertained by applying an electrical signal, and thus the existence of the second state can be detected.

It may be sufficient if the chamber 352 is damaged at a single place with only a small area, in order for the insulation medium to escape from the chamber 352 and the chamber 352 to collapse. Even if it does not lie in the immediate vicinity of the first conductors 321 and of the second conductors 322, an electrical contact between the conductors can take place due to the collapse of the chamber.

A plurality of conductor arrangements 320 can be installed in a cover, or a conductor arrangement can have a plurality of separate chambers 352.

FIG. 4A shows a schematic representation of a second embodiment of a transport goods monitoring device. The transport goods monitoring device 400 differs from the transport goods monitoring device 100 from FIGS. 1A and 1B, inter alia, in that its cover 410 is made from the basic material acrylic glass. As the signal source there is provided an emitter strip 431 comprising a plurality of light emitting diodes that is situated at the lower end of the cover 410 in FIG. 4A. As the measuring device there is provided a receiver strip 433 that is situated at the upper end of the cover 410 in FIG. 4A. It comprises a plurality of light sensors. The emitter strip 431 and the receiver strip 433 are supplied with energy by an energy source 432. Furthermore, there is provided a transmitter 434 that is likewise supplied by the energy source 432. Emitter strip 431, receiver strip 433, energy source 432 and transmitter 434 together form the detector of the transport goods monitoring device 400.

Since the cover 410 is composed of acrylic glass, light emitted by the emitter strip 431 can pass through it to the receiver strip 433. The cover 410 thus forms a conductor arrangement 420. In FIG. 4A, the cover 410 is intact, so that the conductor arrangement 420 is in a first state. This state is distinguished by the fact that light emitted by the emitter strip 431 can pass unimpeded to the receiver strip 433. This is illustrated by the vertical arrows in FIG. 4A.

FIG. 4B shows a schematic representation of the transport goods monitoring device 400 from FIG. 4A after damage of the cover 410, e.g. by a cutting tool, has occurred. The damage is at a place 440. The light transmission function of the cover 410 is impaired at the place 440. This is represented in FIG. 4B with the aid of the arrows ending at the place 440. Owing to the damage to the cover 410, that at the same time forms the conductor arrangement 420, the latter has changed from its first state into a second state. The second state is distinguished by a reduced conducting function in comparison with the first state. This means that a lower proportion of the light emitted by the emitter strip 431 arrives at the receiver strip 433, which the latter registers and thus detects the existence of the second state of the conductor arrangement 420. As already explained with reference to the embodiment in FIGS. 1A and 1B, the output of a corresponding alarm signal can then be effected.

The cover 410 can, for example, be a component part of a transport goods receptacle, e.g. form at least one part of an acrylic glass wall of a transport goods receptacle. For example, the transport goods receptacle can be a container ULD with an acrylic glass wall. The integration of an electrical conductor arrangement into an acrylic glass wall would mean an increased manufacturing expenditure and could be felt to be visually objectionable.

FIGS. 5A and 5B show a schematic representation of a third embodiment of a transport goods monitoring device including energy source 532 and transmitter 534. The transport goods monitoring device 500 differs from the device from FIGS. 4A and 4B primarily in that, instead of the emitter strip 431 and the receiver strip 433, there are provided, on both sides of the acrylic glass cover 510 that forms the conductor arrangement 520, combined emitter/receiver strips 531, 533. As illustrated by the vertical arrows, light can thus pass through the cover 510 both from the strip 531 to the strip 533 and in the opposite direction and can be received by the respectively opposite strip. In FIG. 5A the cover 510 is intact and the conductor arrangement 520 is thus in a first state.

FIG. 5B shows a schematic representation of the transport goods monitoring device 500 from FIG. 5A after damage of the cover 510 has occurred. The damage is at a place 540. This means that, in comparison with the first state of the conductor arrangement 520, both in the case of the emitter/receiver strip 531 and in the case of the emitter/receiver strip 533, a lower proportion of the light emitted by the respectively opposite strip arrives. In this way, both emitter/receiver strips 531, and 533 can ascertain the existence of the second state of the conductor arrangement 520. There is a redundancy, which can provide additional security. For example, the damage of one of the two emitter/receiver strips 531, and 533 can remain without consequences for the reliability of the detection of the existence of the second state.

FIGS. 6A and 6B shows a schematic representation of a fourth embodiment of a transport goods monitoring device including energy source 632 and transmitter 634. The transport goods monitoring device 600 differs from the device from FIGS. 5A and 5B primarily in that the cover 610 that forms the conductor arrangement 620 is surrounded continuously by a combined emitter/receiver strip 633. Emitted light can thus pass through the cover 610 in mutually perpendicular directions, as indicated by the arrows. In FIG. 6A the cover 610 is intact and the conductor arrangement 620 is thus in a first state.

FIG. 6B shows a schematic representation of the transport goods monitoring device 600 from FIG. 6A after damage of the cover 610 has occurred. The damage is at a place 640. The combined emitter/receiver strip 633 is constructed in such a manner that it comprises individually localised light sensors. It can therefore be ascertained which light sensor or light sensors, owing to the damage at the place 640, receive less light than in the first state of the conductor arrangement 620. Since, as shown in FIG. 6B, less light arrives at places of the emitter/receiver strip 633 that is offset in mutually perpendicular directions, this is ascertained at correspondingly offset sensors of the strip 633. Both the vertical and the horizontal position of the place 640 of the damage can thus be determined, so that additional information can be provided to a controller.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the embodiment in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the embodiment as set forth in the appended claims and their legal equivalents.

What is claimed is:

1. A transport goods monitoring device having a cover which is configured to cover transport goods received by a transport goods receptacle, comprising:

an electrical conductor arrangement comprising a first conductor and a second conductor, wherein the first conductor and the second conductor are integrated into a flexible plastic film shaped into a tube, the electrical conductor arrangement configurable in a first state when the cover is intact, and the electrical conductor arrangement transformable from the first state to a second state when the cover is damaged; and a detector that detects the existence of the second state;

wherein the first and the second conductors are insulated from each other by an insulator arrangement in the first state of the electrical conductor arrangement;

wherein an electrically conductive connection exists between the first conductor and the second conductor in the second state of the electrical conductor arrangement; and wherein the insulator arrangement includes at least one chamber formed by the tube and filled with an insulation medium in the first state of the electrical conductor arrangement, and is configured to collapse and allow the insulation medium to escape in the event of damage to the at least one chamber, the first and second conductors thereby coming into contact to establish the electrically conductive connection.

2. The transport goods monitoring device of claim 1, wherein the detector is coupled to the electrical conductor arrangement.

3. The transport goods monitoring device of claim 1, wherein the detector is configured to generate a signal upon the detection of the second state.

4. The transport goods monitoring device of claim 1, wherein the second state is distinguished by an altered conducting function of the electrical conductor arrangement in comparison with the first state.

5. The transport goods monitoring device of claim 1, wherein the transport goods monitoring device is assigned a signal source for applying a signal to the conductor arrangement that is suitable for being conducted by the electrical conductor arrangement in at least one state of the electrical conductor arrangement.

6. The transport goods monitoring device of claim 1, wherein the cover is flexible.

7. The transport goods monitoring device of claim 1, wherein the cover comprises rigid walls and is foldable.

8. An apparatus for transporting goods, comprising:

a transport goods receptacle configured to receive transport goods; and a transport goods monitoring device according to claim 1, the cover of the transport goods monitoring device covering at least one of the transport goods receptacle and the transport goods arranged thereon.

9. A method for transporting goods, comprising:

receiving the goods in a transport goods receptacle; and covering the goods in the receptacle using a cover having an electrical conductor arrangement comprising a first conductor and a second conductor, wherein the first conductor and the second conductor are integrated into a flexible plastic film shaped into a tube, the electrical conductor arrangement transformable from a first state to a second state when the cover is damaged;

wherein the first and the second conductors are insulated from each other by an insulator arrangement in the first state of the electrical conductor arrangement;

wherein an electrically conductive connection exists between the first conductor and the second conductor in the second state of the electrical conductor arrangement;

wherein the insulator arrangement includes at least one chamber formed by the tube and filled with an insulation medium in the first state of the electrical conductor arrangement; and wherein the at least one chamber collapses and allows the insulation medium to escape in the event of damage to the at least one chamber, the first and second conductors thereby coming into contact to establish the electrically conductive connection.

10. A method according to claim 9, further comprising executing the existence of the second state.

* * * * *